US005175487A

United States Patent [19]

Inoue

[11] Patent Number: 5,175,487

[45] Date of Patent: Dec. 29, 1992

[54] OUTPUT CIRCUIT

[75] Inventor: Michiya Inoue, Hachioji, Japan

[73] Assignee: Fanuc Limited, Minamitsuru, Japan

[21] Appl. No.: 445,628

[22] PCT Filed: Mar. 23, 1989

[86] PCT No.: PCT/JP89/00309

§ 371 Date: Nov. 28, 1989

§ 102(e) Date: Nov. 28, 1989

[87] PCT Pub. No.: WO89/10591

PCT Pub. Date: Nov. 2, 1989

[30] Foreign Application Priority Data

Apr. 22, 1988 [JP] Japan ..... 63-099465

[51] Int. Cl.[5] ..... G05F 1/56

[52] U.S. Cl. ..... 323/303; 323/902; 323/276; 307/311

[58] Field of Search ..... 323/299, 303, 268, 274, 323/902, 276, 351, 284, 221; 307/311

[56] References Cited

U.S. PATENT DOCUMENTS

| | | | |
|---|---|---|---|
| 3,649,906 | 3/1972 | Carpentier et al. | 323/268 |
| 3,754,182 | 8/1973 | Morris et al. | 323/299 |
| 4,264,830 | 4/1981 | Maurer et al. | 323/326 |
| 4,401,936 | 8/1983 | van Opijnen | 323/276 |
| 4,535,282 | 8/1985 | Nguyen | 323/276 |
| 4,660,135 | 4/1987 | Lee | 323/299 |
| 4,792,747 | 12/1988 | Schroeder | 323/303 |
| 4,967,138 | 10/1990 | Obergfell et al. | 323/299 |
| 5,043,587 | 8/1991 | Miki et al. | 250/551 |

FOREIGN PATENT DOCUMENTS

| | | | |
|---|---|---|---|
| 3536819A1 | 4/1987 | Fed. Rep. of Germany . | |
| 5120139 | 8/1974 | Japan . | |
| 5720005 | 6/1980 | Japan . | |
| 0983685 | 12/1982 | U.S.S.R. | 323/276 |

*Primary Examiner*—Steven L. Stephan
*Assistant Examiner*—Ben Davidson
*Attorney, Agent, or Firm*—Staas & Halsey

[57] ABSTRACT

An output circuit provided with a photo coupler for transmitting a control signal from a control circuit to an output side in an electrically isolated condition, a load driving transistor (15), and a power supply stabilizing circuit (15) for supplying an electric power for driving the load driving transistor (13) from a load side power supply (13). The power supply stabilizing circuit includes a low voltage detection circuit and an input/output short-circuiting circuit, and the input/output short-circuiting circuit is made conductive when an input voltage to the power supply stabilizing circuit is determined to be lower than a predetermined voltage. As a result, even if the load side power supply has a low voltage, it can drive the load driving transistor, and thus the load side power supply can be used over a wide range of voltages.

6 Claims, 2 Drawing Sheets

OUTPUT CIRCUIT

BACKGROUND OF THE INVENTION

1. Field of the Invention

The present invention relates to an output circuit, and more specifically, to an output circuit capable of being operated by a wide range of power supply voltages.

2. Description of the Related Prior Art

Various kinds of relays, solenoids and the like are coupled with an output circuit of a programmable controller (hereinafter, referred to as a PC), a numerical control apparatus (hereinafter, referred to as an NC) and the like, and load elements such as these relays, solenoids and the like have various electric specifications with coil voltages of DC 12 V, DC 24 V, DC 48 V, AC 100 V, AC 200 V and the like. To comply with load elements having such a wide variety of characteristics and specifications, the PC and NC are generally provided with output circuits having various characteristics and these output circuits are suitably combined and used in accordance with a combination of the loads.

As described above, although various kinds of output circuits are generally provided for the PC and NC in accordance with the kind of load, a great many kinds of output circuits are required because they are composed of combinations of DC, AC, load voltages and load currents.

Accordingly, the development of an output circuit which can be operated by a wide range of voltages is now underway, to enable a reduction of the number of the output circuits needed. For example, a circuit is available which can be operated by voltages from DC 12 V to DC 24 V or voltages from AC 100 V to AC 200 V and the like.

Note, since many loads composed of TTL's operated by a power supply voltage of DC 5 V are used, the realization of an output circuit which can be operated by voltages ranging from DC 5 V to DC 24 V or from DC 5 V to DC 48 V will greatly reduce the kinds of output circuit modules needed. Conventionally, however, it has been difficult to produce a low cost output circuit which can be operated by this range of voltages.

SUMMARY OF THE INVENTION

Taking the above into consideration, an object of the present invention is to provide an output circuit which can be operated by a wide range of power supply voltages.

To solve the above problem, in accordance with the present invention, there is provided an output circuit provided with a photo coupler for transmitting a control signal from a control circuit to an output side while being electrically isolated, a load driving transistor, and a power supply stabilizing circuit for supplying electric power for driving the load driving transistor from a load side power supply, wherein the output circuit is characterized in that the power supply stabilizing circuit includes a low voltage detection circuit and an input output short circuiting circuit and that the input output short circuiting circuit is made conductive to short-circuit the input and output of the power supply stabilizing circuit when the low voltage detection circuit detects that an input voltage to the power supply stabilizing circuit is lower than a predetermined voltage.

The input output short circuiting circuit may include a transistor bridging the power supply stabilizing circuit as a short-circuit switch element.

When the low voltage detection circuit detects that an input voltage to the power supply stabilizing circuit is lower than a predetermined voltage, the short-circuit switch element of the input output short circuiting circuit is made conductive. When a transistor is used as the short-circuit switch element, the input voltage can be effectively transmitted to the output side with a voltage drop restricted to a low level, since it has a relatively small collector-emitter saturated voltage.

DESCRIPTION OF THE PREFERRED EMBODIMENT

Figure 1:
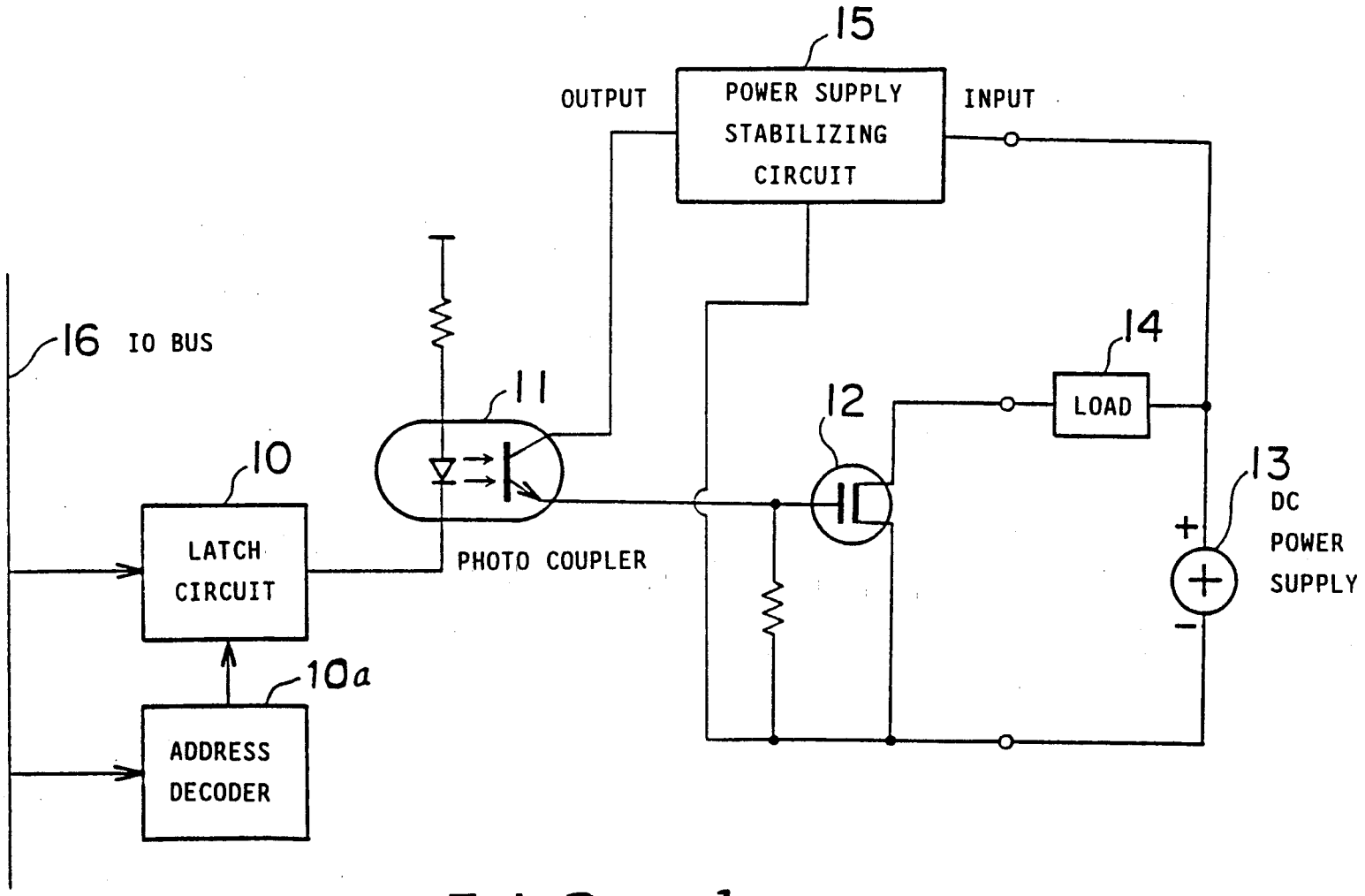
FIG. 1 is a circuit diagram of an embodiment of an output circuit according to the present invention.

FIG. 1 shows an output circuit of a PC and NC according to the present invention, wherein an output ON/OFF control signal from a control unit (not shown) is stored in a latch circuit 10 through an I/O bus 16, the addresses of the latch 10 are selected by an address decoder 10*a*, and an output from the latch 10 drives the gate of an output transistor 12 through a photo coupler 11. The output transistor 12 is a MOS type FET.

A DC power supply 13 coupled with a load side is selected in accordance with the rating of a load 14 and, for example, a voltage of 12 V, 24 V, 48 V or the like is used.

The power supply stabilizing circuit 15 is inserted to stabilize the various power supply voltages to be applied to the control gate of the output transistor 12.

Note, recently the gate voltage of an FET has been gradually made lower, and thus an FET which is turned on by a gate-source voltage $V_{GS}$ of 4 V is readily available. The use of this FET makes it possible to constitute an output circuit capable of complying with a load having a rating voltage of 5 V. In this case, the circuit shown in FIG. 1 is always operated as required even when a power supply voltage from the load is 5 V.

With a conventional series dropper type power supply stabilizing circuit, however, a voltage of 4 V as a gate-source voltage of the FET 12 cannot be assured in worst case conditions in which a power supply voltage is at the lower limit of its voltage fluctuation range and a voltage drop has occurred at the transistor in the stabilizing circuit, whereby a voltage drop of the photo coupler 11 and the like has a worst case value. That is, the operation of the FET 12 cannot be always assured.

The present invention is intended to solve this problem by providing an output circuit which can be securely operated even when the power supply voltage is DC 5 V.

Figure 2:
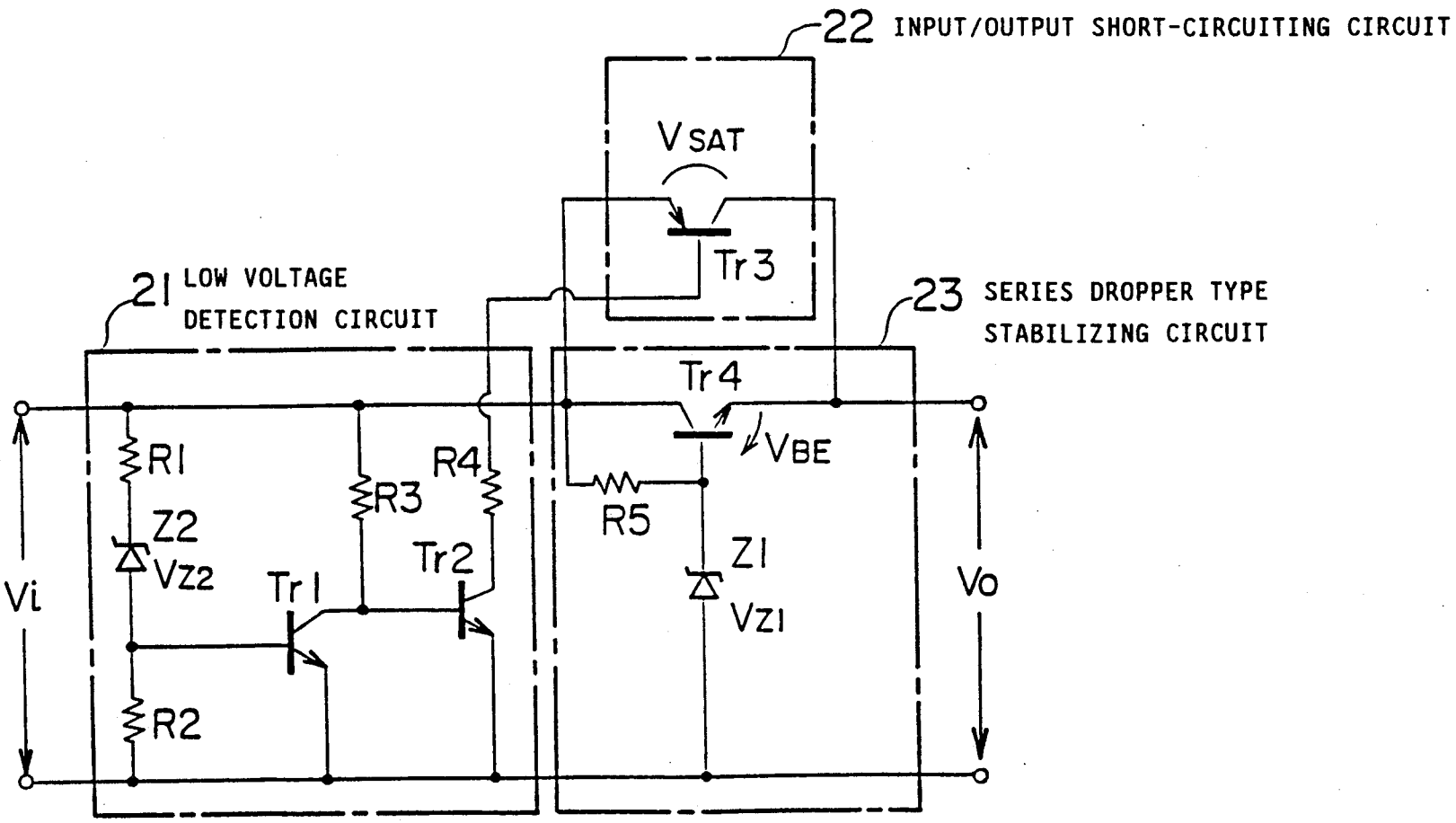
FIG. 2 is a circuit diagram of a power supply stabilizing circuit.

The power supply stabilizing circuit shown in FIG. 2 is used as the power supply stabilizing circuit 15 which is an element constituting the output circuit shown in FIG. 1.

The circuit shown in FIG. 2 includes a low voltage detection circuit 21, an input output short circuiting circuit 22, and a series dropper type stabilization circuit 23.

The low voltage detection circuit 21 includes transistors Tr1 and Tr2, a zener diode Z2, and resistors R1, R2, R3 and R4.

The input output short circuiting circuit 22 includes a transistor Tr3 as a short-circuit switch element.

The series dropper type stabilization circuit 23 includes a transistor Tr4, a zener diode Z1, and a resistor R5. Accordingly, assuming that:

Vi; input voltage

Vo; output voltage

Vz1; zener voltage of the zener diode Z1

Vz2; zener voltage of the zener diode Z2

$V_{BE}$; base-emitter voltage $V_{SAT}$; collector-emitter saturated voltage and Vz1>Vz2:

(i) the circuit shown in FIG. 1 operates as a usual series dropper type stabilizing circuit in the range of Vi>Vz1 and the output voltage Vo is as follows;

$$Vo = Vz1 - V_{BE}$$

(ii) the stabilizing capability of the circuit shown in FIG. 1 is lost in the range of Vz1>Vi>Vz2 and the output voltage is as follows.

$$Vo = Vi - V_{BE}$$

(iii) the low voltage detection circuit 21 shown in FIG. 2 short-circuits the input output short circuiting circuit 22 in the range of Vz2>Vi. That is, the transistor Tr1 is turned off, the transistors Tr2 and Tr3 are turned on, and the output voltage Vo is as follows.

$$Vo = Vi - V_{SAT}$$

With this arrangement, if the Vz1 is set to 10 V and the Vz2 is set to 5 V, for example, the output voltage Vo is about 10 V when a power supply voltage on the load side is DC 12 V, DC 24 V or DC 48 V. In addition, when a power supply voltage on the load side is DC 5 V, the output voltage Vo is as follows.

$$Vo = 5\ V - V_{SAT} \approx 4.8\ V$$

Consequently, even in the case of a voltage fluctuation and the electric characteristics of parts and the like are in the worst case condition, a gate voltage of 4 V at the FET 12 in FIG. 1 can be assured.

According to the present invention, as described above, since the input output short circuiting circuit is made conductive when the low voltage detection circuit detects that an input voltage to the power supply stabilizing circuit is lower than a predetermined voltage, the output circuit can be operated by the power supply voltages on the load side which are in a wide range from DC 5 V to DC 48 V, and as a result, the kinds of output circuit modules needed for the PC and NC can be greatly reduced.

I claim:

1. An output circuit provided with a photo coupler means for transmitting a control signal from a control circuit to an output side while being electrically isolated, a load driving transistor, and power supply stabilizing circuit means for supplying electric power for driving the load driving transistor from a load side power supply, characterized in that:

said power supply stabilizing circuit means includes a low voltage detection circuit and an input output short circuiting circuit; and said input output short circuiting circuit is made conductive when said low voltage detection circuit detects that an input voltage to said power supply stabilizing circuit is lower than a predetermined voltage, wherein a DC voltage supply, operatively connected to a gate of said load driving transistor and having a voltage in a range from about 5 V to 48 V, stably supplies at least abut 4 V to said gate of said load driving transistor.

2. An output circuit according to claim 1, wherein said input output short circuiting circuit includes a transistor means for selectively short-circuiting an input to said power supply stabilizing circuit and an output to said power supply stabilizing circuit.

3. An output circuit according to claim 1, wherein a DC voltage supply coupled with a load side will always operate said load driving transistor by a voltage in a range of from 5 V to 48 V.

4. An output circuit according to claim 1, wherein said predetermined voltage is about 5 V.

5. An output circuit, comprising:

a load operatively connected to a DC power supply through an output transistor;

a photo coupler operatively connected to the DC power supply and the output transistor so as to drive a gate of the output transistor with a power supply voltage;

a power supply stabilizing circuit interposed between and operatively connected to the DC power supply and the photo coupler so as to stabilize the power supply voltage, wherein the power supply stabilizing circuit includes a low voltage detection circuit and an input output short circuiting circuit; and wherein the input output short circuiting circuit is conductive when the low voltage detection circuit detects that a voltage of the DC power supply is lower than a predetermined value and the input output short circuiting circuit is non-conductive when the low voltage detection circuit detects that the voltage of the DC power supply is higher than the predetermined value, whereby the gate of the output transistor is securely driven with a voltage of at least about 4 V when the voltage of the DC power supply is about 5 V to 48 V.

6. An output circuit having a load operatively connected to a DC power supply through an output transistor, a photo coupler operatively connected to the DC power supply and the output transistor so as to drive a gate of the output transistor with a power supply voltage, and a power supply stabilizing circuit interposed between and operatively connected to the DC power supply and the photo coupler so as to stabilize the power supply voltage, comprising:

low voltage detection circuit means for detecting when a voltage of the DC power supply is lower than a predetermined voltage; and input output short circuiting circuit means, operatively connected to the DC power supply and the photo coupler, for connecting the DC power supply and the photo coupler when the low voltage detection circuit detects that the voltage of the DC power supply is lower than about 5 V so that the gate of the output transistor is securely driven with a voltage of at least about 4 V when the voltage of the DC power supply is about 5 V.

* * * * *